US005337420A

United States Patent [19]

Haysom et al.

[11] Patent Number: 5,337,420

[45] Date of Patent: Aug. 16, 1994

[54] METHOD AND APPARATUS FOR MOUNTING AND LOCATING A HELMET COMFORTABLY ON THE HEAD OF A PERSON, AND COMBINATION RESULTING THEREFROM

[76] Inventors: Elbert M. Haysom, 1527 San Carlos, Orange, Calif. 92665; Keith N. Groves, 1779 E. 4500 South, Salt Lake City, Utah 84124

[21] Appl. No.: 970,618

[22] Filed: Nov. 3, 1992

[51] Int. Cl.[5] ..... A42B 1/06

[52] U.S. Cl. ..... 2/410; 2/417; 2/425; 2/181

[58] Field of Search ..... 2/410, 411, 412, 413, 2/414, 416, 417, 418, 419, 420, 422, 425, 181, 183, 181.6, DIG. 11

[56] References Cited

U.S. PATENT DOCUMENTS

| | | | |
|---|---|---|---|
| 1,391,753 | 9/1921 | Baier . | |
| 1,681,111 | 8/1928 | Garfield | 2/183 |
| 2,816,290 | 12/1957 | Boyer | 2/413 |
| 2,923,941 | 2/1960 | Roth et al. | 2/416 |
| 3,015,103 | 1/1962 | Zbikowski | 2/416 |
| 3,413,656 | 12/1968 | Vogliano et al. | 2/416 |
| 3,668,704 | 6/1972 | Conroy et al. | 2/3 R |
| 3,806,950 | 4/1974 | Spencer-Foote | 2/3 R |
| 4,023,213 | 5/1977 | Rovani | 2/413 |
| 4,035,846 | 7/1977 | Jencks | 2/413 |
| 4,038,700 | 8/1977 | Gyory | 2/413 |
| 4,051,555 | 10/1977 | Daly | 2/412 |
| 4,287,613 | 9/1981 | Schulz | 2/413 |
| 4,354,283 | 10/1982 | Gooding | 2/413 |
| 4,354,284 | 10/1982 | Gooding | 2/413 |
| 4,502,156 | 3/1985 | Wishman | 2/181 |
| 4,677,694 | 7/1987 | Crow | 2/425 |
| 4,833,734 | 5/1989 | DerEstephanian | 2/181 |
| 5,003,631 | 4/1991 | Richardson | 2/6 |
| 5,014,365 | 5/1991 | Schulz | 2/412 |
| 5,014,366 | 5/1991 | Discipio, Sr. | 2/424 |
| 5,031,246 | 7/1991 | Kronenberger | 2/413 |
| 5,031,246 | 7/1991 | Kronenberger | 2/197 |
| 5,050,245 | 9/1991 | Nearhood | 2/410 |
| 5,083,320 | 1/1992 | Halstead | 2/413 |
| 5,105,476 | 4/1992 | Cox | 2/DIG. 11 |
| 5,142,705 | 9/1992 | Edwards | 2/183 |

*Primary Examiner*—Clifford D. Crowder
*Assistant Examiner*—Michael A. Neas
*Attorney, Agent, or Firm*—Richard L. Gausewitz

[57] ABSTRACT

A method of locating properly and comfortably a protective helmet on the head of a person. A fit, locating and comfort band is mounted around the persons head, namely adjacent the ears and the back of the head and over the forehead. Thereafter, a protective plastic helmet having a foam lining is mounted over the band as a separate and distinct operation. The method further comprises employing a harness above the band to aid in keeping it in place while the helmet is subsequently mounted, and to protect the top of the head from discomfort caused by a central foam element of the helmet. The apparatus comprises the band and harness and helmet employed in combination with each other, but with no need for the band or harness to be connected to the helmet. In accordance with another aspect of the method and apparatus, an inflatable bladder is employed to aid in maintaining the band and helmet in the desired positions.

18 Claims, 2 Drawing Sheets

METHOD AND APPARATUS FOR MOUNTING AND LOCATING A HELMET COMFORTABLY ON THE HEAD OF A PERSON, AND COMBINATION RESULTING THEREFROM

BACKGROUND OF THE INVENTION

Baseball helmets for minors typically consist of a hard thin shell of solid synthetic resin, inside which is fixedly secured a foam material that is often quite hard—for example at the front and back of the shell. It is conventional for the manufacturers of such baseball helmets to make all of the shells the same size, and then achieve size variations by changing the thickness of the foam material. Thus, the foam in a large-size helmet is relatively thin in comparison to that in a small-size helmet.

Regardless of the size of the person's head, the baseball helmets often do not fit well. Thus, for example, it has become a stereotype of children's baseball to show—for example in a motion picture—a protective helmet sliding around on the minor's head as he or she runs the bases.

A related problem is that of discomfort at the crown of the minor's head. The heavy helmet slides little or much relative to the head, which is not at all comfortable.

What are needed are a method and apparatus whereby stock, off-the-shelf conventional helmets can be made to fit comfortably on the head, with little or no difficulty and at low cost.

SUMMARY OF THE INVENTION

A protective helmet having a shock-absorbing lining is provided but not yet mounted on the head.

The athlete mounts a fit and comfort band around his or her head, namely across the forehead, adjacent the ears, and above the neck—such band being associated with a harness that extends over the head.

Thereafter, as a separate operation, the athlete places over the fit and comfort band and over the harness the protective helmet, in such relationship that the band fits between the head and the foam or other shock-absorbing lining.

In accordance with one embodiment of the method of the invention, a subsequent step is then performed as a separate operation, namely that an air bladder is pumped up to occupy an additional amount of space between the fit and comfort band and the helmet lining.

In accordance with the apparatus of the invention, the fit and comfort band is thin in a direction perpendicular to the skull of the wearer and, furthermore, has an outer layer that does not bind or grip relative to the (usually) foam liner of the helmet. This construction, coupled with a function of the harness, prevent the fit and comfort liner from sliding downwardly as the helmet is mounted. Preferably, in accordance with an aspect of the method, the helmet is spread apart at the ear portions thereof during the mounting operation.

In accordance with another aspect of the invention, the fit and comfort band is in three layers, including the above-mentioned outer layer and a thin interior cushion and sweat-absorbing substance. The inner layer is a sweat-absorbing cloth.

The harness comprises stretch bands that extend upwardly from the fit and comfort band to a central crown that rests beneath the center of the helmet. The crown pad is a major part of the preferred embodiment in that it makes the combination greatly more comfortable.

A resilient connection element is provided between adjacent regions of the fit and comfort band to permit the same to adapt to different sizes of heads, within a predetermined range.

DISCLAIMER

Strictly for purposes of description, and for no other reason, there are employed in this specification and claims such words as "protective", "shock-absorbing", etc. It is emphasized, however, that the present applicants have nothing to do with the construction of any helmet (including the shell and/or foam or other liner portion therein). An off-the-shelf helmet is employed, and applicants neither know nor represent that there is any protective of shock absorbing action effected by that helmet. The present fit and comfort liner, including the harness and crown pad (and the bladder and pump when one is employed), do not perform any shock-absorbing function.

DETAILED DESCRIPTION OF THE PREFERRED EMBODIMENT

Figure 4:
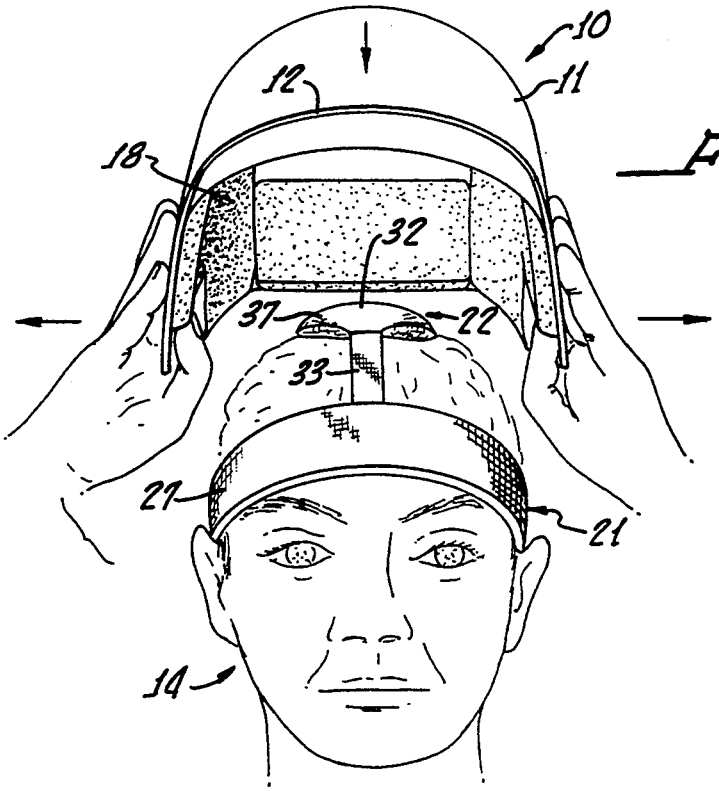
FIG. 4 is a front isometric view showing mounting of the helmet over the fit and comfort band and the associated harness and crown pad.
Figure 5:
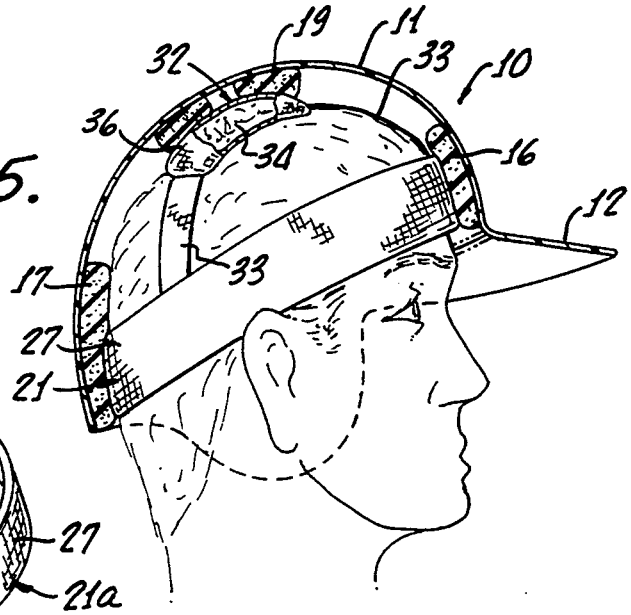
FIG. 5 is a generally vertical central sectional view of the helmet, in combination with a side elevational view of the band, harness and the head of the athlete.

Referring first to FIGS. 4 and 5, a typical baseball helmet for minors is shown at 10. It has a hard solid synthetic resin helmet-shaped shell 11 that is integral with a visor 12. Padding is mounted to the interior of shell 11 for the purpose of cooperating with the shell to provide a degree of protection of the head 14 of the athlete from baseballs, etc.

Typically, the padding is foam synthetic resin. It typically includes front and back pads 16,17 that are quite hard foam resin but are intended to absorb shocks. It also typically includes side pads 18 that are foam synthetic resin and are typically of an intermediate hardness/softness. At the upper-inner crown portion of the shell 11 is mounted a donut-shaped pad 19 of soft foam synthetic resin. The pads 16–18 typically extend all the way around the front, back and sides of the helmet, and they typically have relatively flat interior surfaces. The latter are often spaced somewhat away from head 14 because it does not occur in a high percentage of cases that the interior surfaces of pads 16–18 are in just exactly the "right" position relative to the head 14 on which the helmet is mounted. As above indicated, the helmets are instead usually too large and therefore tend to slide relative to the head when the head jerks during batting or base running, etc.

It has now been conceived to provide a thin fit and comfort band 21 that is associated with a harness 22, and crown pad, which fits over the athlete's head 14.

Figure 1:
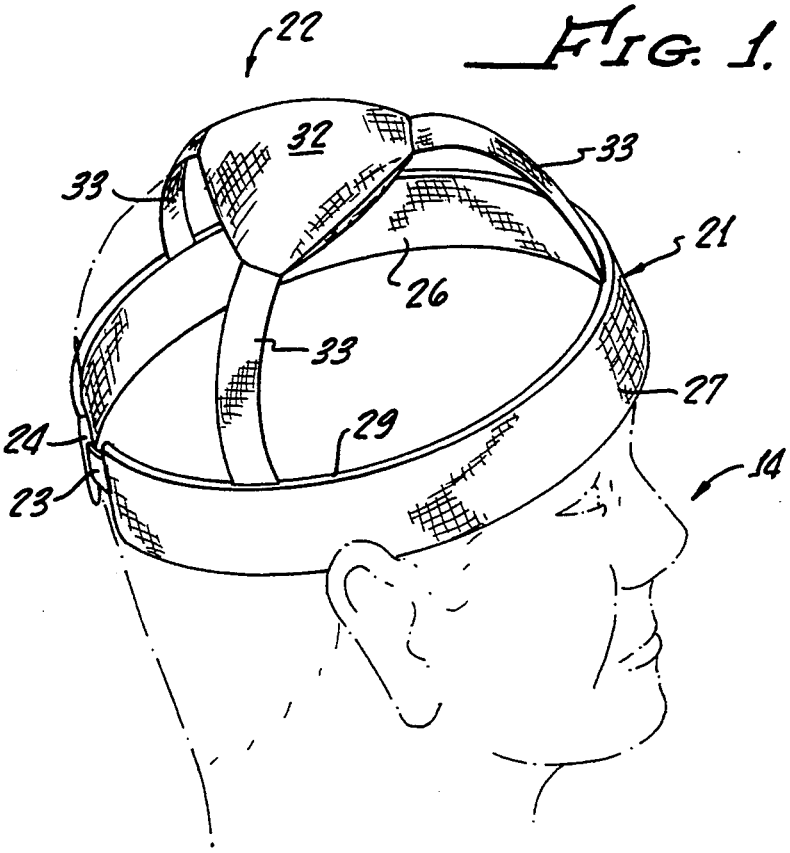
FIG. 1 is an isometric view of an apparatus constructed in accordance with the present invention, as mounted on the head of an athlete.
Figure 2:
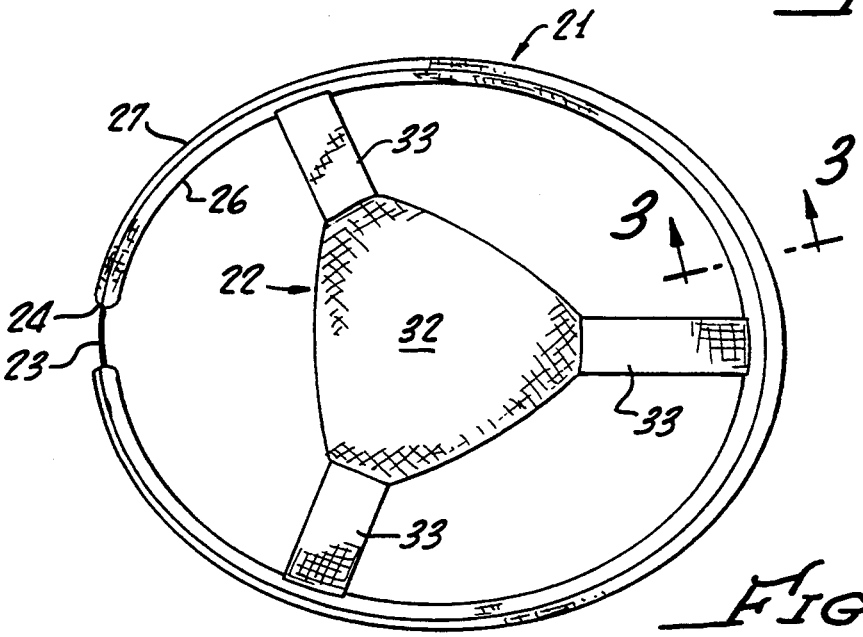
FIG. 2 is a top plan view of the showing of FIG. 1.

The band 21 is adapted to extend around the head at such a location and orientation that it is present where the interior surfaces of the lower regions of pads 16–18 are subsequently present (FIG. 5). The band 21 is resiliently, but without enough tension to create discomfort, "stretched" around the head 14 so as to be mounted thereon with a reasonable amount of pressure against the head. Referring to FIG. 1, and FIG. 2, there is an elastic stretch strip 23 sewn into a gap region 24 in the band 21 in order to create a tensioning action relative to the band. It is to be understood that more than one strip 23 (with associated gap regions) may be provided about the circumference of the band 21.

The fit and comfort band 21 is thin, for example about one-eighth inch in thickness, when it is mounted on the head 14.

Figure 3:
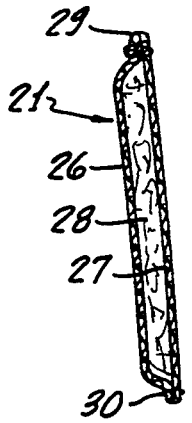
FIG. 3 is an enlarged cross-sectional view taken on line 3—3 of FIG. 2.

It its preferred form, the band has a 100% cotton knit inner layer 26. This layer 26 is thin, being analogous to the cloth out of which conventional tee shirts are made. The outer layer, number 27 in FIG. 3, is in the preferred form cotton broadcloth. Provided between the layers 26,27 is a core layer 28 of fiberfill, namely the same material that is conventionally employed as a core layer in quilts. The layer 28 is approximately ⅛ inch thick. It is preferably of the type that is provided with an adhesive on one side and is ironed on to one of the layers 26,27.

In accordance with another specific embodiment, not preferred, the outer layer is stretch Lycra and the inner layer is fine terry cloth.

The upper and lower edges of the fit and comfort band 21 are sewn at seams 29,30 indicated in FIG. 3.

Especially because of the core 28, the fit and comfort band keeps it shape when on the shelf and not in use, instead of merely collapsing into a seeming mass of cloth. By "keeps it shape" it is not intended to denote that the band necessarily remains in a circular configuration when not on the head of the user; it normally does not.

The fit and comfort band 21 occupies the gap between the inner surfaces of pads 16–18 and the opposed outer surfaces of the athlete's head 14. In other words, the band 21 occupies what may be termed the "margin of fit" that is present because of the fact that the majority of helmets are oversize.

Because of the fact that the outer layer 27 is broadcloth or "Lycra", or some other relatively low friction material, the fit and comfort band is not "grabbed" by the (normally) foam synthetic resin pads 16–18. In other words, when the helmet 11 is being mounted on the head as described subsequently, the pads 16–18 do not excessively hold or grip the band 21 and move it downwardly below the desired position.

The preferred width for the band is about two inches.

Proceeding next to a description of the harness and protective and supportive element 22, this is illustrated to comprise a crown pad 32 that is connected to the fit and comfort band 21. Crown pad 32 is connected to the band 21 by a plurality of circumferentially-spaced flexible strips 33, preferably three strips spaced at 120-degree intervals. The strips 33 are preferably stretch elastic strips. The strips 33 are preferably woven elastic material and are sewn at their lower ends to upper seam 29 and at their upper ends to the crown pad 32. Means, not shown, may be provided to vary (adjust) the lengths of the strips 33 for closer fits on different sizes of heads 14.

Crown pad 32 is centrally located at the upper part of the athlete's head 14, being held in position by the strips 33 which, in turn, are anchored on the fit and comfort band 21. Thus, it is pointed out that the fit and comfort band 21 serves also as a mounting band or anchor band in that it supports and locates and anchors the strips 33 that keep the crown pad 32 in the proper location.

Figure 6:
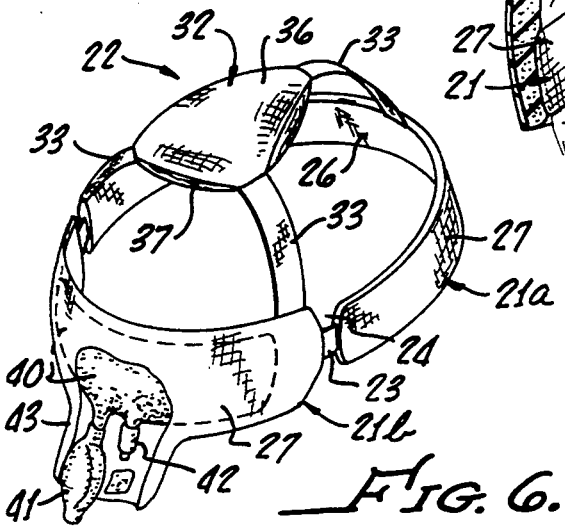
FIG. 6 is an isometric view of an apparatus constructed in accordance with a second embodiment, in which bladder and associated pump means are provided in association with the fit and comfort band, portions being broken away to show parts of these elements.

As best shown in FIGS. 5 and 6, crown pad 32 is a relatively thick soft core element 34 that is encased in a cloth cover 36 formed (for example) of "Lycra". The crown pad 32 may be, for example, generally triangular as illustrated, with each side having a length of preferably about four inches. The thickness of the crown pad 32 is preferably about three-quarter inch. The upper ends of flexible strips 33 are sewn into an edge seam 37 that connects an upper layer of cloth 36 with a lower layer thereof.

It is to be understood that all of the cloth described in this application may be made highly decorative. Furthermore, the flexible strips 33 may be covered with decorative cloth or other material that is not uncomfortable or injurious to the head 14 of the athlete.

It is to be understood that the donut 19 (FIG. 5) may become hard with time, and also may tend to shed or break off small foam regions that can tangle with the hair of the wearer. In any event, the helmet is or seems quite heavy, especially for a minor. When the minor is in constant movement, there is a certain amount of rubbing between the crown and the donut 19, despite the action of the fit and comfort band 21 in maintaining the helmet 10 against substantial movements relative to the head 14. For all of these reasons, the crown pad 32 portion of harness 22 cooperates with the fit and comfort band 21 in keeping the athlete comfortable despite wearing of the helmet 10 over what may be relatively long periods of time.

DESCRIPTION OF THE METHOD

As the first step, the athlete selects a fit and comfort and anchoring band 21 of such size that it fits resiliently around the head 14 closely but with insufficient tension to create discomfort. The band is located in the illustrated position (FIGS. 4 and 5) that is described above. The lengths of the strips 33 are such that, when the band 21 is mounted as shown and described, the crown pad 32 is located over the crown of the head.

As the next step in the method, the athlete grasps the ear pieces of his or her helmet 10 (FIG. 4) and spreads them apart, while moving the helmet down over the head and over the previously-mounted band 21 and harness 22. The helmet is moved down to the position shown in FIG. 5, and the ear pieces are released.

Because of the fact that the helmet is somewhat larger than the head 14, so that there is the above-indicated margin of fit between pads 16–18 and the exterior of the head 14, and because of the fact that the outer layer 28 of cloth is not such as to "grab" relative to the foam synthetic resin (or other pad) elements 16–18, and because of the presence of the strips 33 which tend to hold the band 21 in its proper position despite the downward movement of the helmet 10, the band 21 and thus crown pad 32 remain in the illustrated locations or ones relatively near them.

In addition, the crown pad 32 aids in keeping the band 21 in its proper position because the crown pad holds the helmet 10 at a sufficiently high elevation that the helmet does not by gravity tend to effect substantial downward movement of the band 21.

The baseball or other activity is then performed by the person wearing the helmet and the present apparatus, following which the helmet and the band 28 and harness 22 are removed from the head 14.

While the band 21 is still in place, it absorbs sweat.

While the helmet 10 is not in position, the combination harness 22-band 21 may remain in position as a decorative element. As previously indicated, it may have various colors and decorations and patterns, may bear the insignia of a team, etc.

METHOD AND ARTICLE OF FIG. 6

Referring next to FIG. 6, the construction and method are identical to that described above relative to FIGS. 1–5, inclusive, except as specifically stated below.

In the article of FIG. 6, a horizontally-elongate flexible bladder 40 is sewn into the fit and comfort band 21 between the layers thereof. Preferably, there are two sections of the band, namely a forward section 21*a* that is identical to the one 21 described above except for length, and a rear section 21*b* that preferably has a somewhat greater vertical dimension than does the forward section 21*a*. The bladder 40 shown in FIG. 6 is mounted in the rear section 21*b*.

In FIG. 6, the outer layer 27 of cloth of the rear section 21*b* of the band is broken away in order to illustrate pump and valve elements associated with the bladder, as well as to show part of the bladder 40. Thus, there is a squeeze bulb 41 have check valves therein in order to pump up the bladder when the squeeze bulb is repeatedly compressed. A release valve 42 is also associated with the bladder and is adapted to release air therefrom when pressed by the wearer. In an alternative construction, not shown, the bulb for pumping up the bladder is incorporated in the same location as the release valve.

Dependent cloth regions are provided forwardly and rearwardly of the bulb 41 and valve 42, hanging downwardly from the cloth portions that are on opposite sides of (forwardly and rearwardly of) these elements, to conceal them.

In performing the method with the embodiment of FIG. 6, the athlete first mounts the elements 21*a* and 21*b* on the head, together with the harness 22, as described relative to FIGS. 1–5. The bulb 41, etc., is located at the rear of the head. It is always known that the bulb will be at the rear because if it is put at the front it will hang down before the person's eyes, and if it is put at the side it will hang down over the ears and interfere with proper mounting of the helmet 10.

After the above-indicated method (described relative to FIGS. 1–5) is completed, the final step is performed of squeezing repeatedly on bulb 41 to increase the thickness of the bladder-associated region of rear portion 21*b* of the band. This increases the tightness of the fit between the helmet and the head. After the athletic activity is completed, the release valve 42 is pressed to release air from the bladder, following which the helmet, or the helmet and present apparatus as desired, are removed.

The foregoing detailed description is to be clearly understood as given by way of illustration and example only, the spirit and scope of this invention being limited solely by the appended claims.

What is claimed is:

1. A method of improving the fit and comfort of a protective helmet on the head of a person, which comprises:

(a) providing a fit and comfort band constructed and sized to fit resiliently around the head of a person with sufficient tightness to be a close fit on such head, but without sufficient tightness to create discomfort;

(b) providing a harness to support said band,
said harness being adapted to rest on top of such head, (c) mounting said band around such head and said harness over such head, so that said band extends across the forehead, and across the back of such head at the upper end of the neck,
said mounting step being performed without any helmet being present on such head, (d) providing a protective helmet for such head,
said helmet having interior padding or lining that at the interior thereof is sized to fit such head but with sufficient clearance that said band will fit between such head and said padding or lining when said band is mounted around such head, and (e) mounting said helmet on such head in such manner that said padding or lining fits around said band adjacent thereto,
said mounting of said helmet being effected as a separate step subsequently to said step of mounting said band and harness on such head.

2. The invention as claimed in claim 1, in which said method further comprises employing as said fit and comfort band a thin plural-layer band having an outer cloth layer, an inner cloth layer, and fill therebetween.

3. The invention as claimed in claim 1, in which said method further comprises performing said method relative to a person who is a minor, and employing as said protective helmet a baseball helmet having a solid synthetic resin shell on which there is a visor, and having, as said interior padding or lining, foam synthetic resin.

4. A method of improving the fit and comfort of a protective helmet on the head of a person, which comprises:

(a) providing a fit and comfort band constructed and sized to fit resiliently around the head of a person with sufficient tightness to be a close fit on such head, but without sufficient tightness to create discomfort;

(b) mounting said band around such head, so that said band extends across the forehead, and across the back of such head at the upper end of the neck,
said mounting step being performed without any helmet being present at such head, (c) mounting a crown pad above such head at the top-center thereof, and anchoring said pad to said fit and comfort band, (d) providing a protective helmet for such head, said helmet having interior padding or lining that at the interior thereof is sized to fit such head but with sufficient clearance that said band will fit between such head and said padding or lining when said band is mounted around such head, and (e) mounting said helmet on such head in such manner that said padding or lining fits around said band adjacent thereto,
said mounting of said helmet being effected as a separate step subsequently to said step of mounting said band.

5. The invention as claimed in claim 4, in which said crown-pad-mounting step is performed simultaneously with said step of mounting said band around said head, by causing said crown pad to be anchored to said band before said band is mounted on such head.

6. A combination protective helmet and comfort element for an athlete, said combination comprising:

(a) a protective athletic helmet having a synthetic resin shell,
said shell having padding or lining interiorly thereof, (b) a closed-loop element adapted to circle the head of an athlete at the forehead and back of the head, (c) a pad adapted to protect the crown of the head from said athletic helmet, and (d) means to connect said pad to said closed-loop element in such manner that said pad is maintained positioned over such crown when said closed-loop element is mounted on such head in circling relationship,
characterized in that said helmet, closed-loop element and pad are all present at the same time on said head so that said pad aids in supporting said helmet and preventing chafing of said crown by said helmet,
and further characterized in that neither said closed-loop element nor said pad nor said connector means is secured to said helmet.

7. The invention as claimed in claim 6, in which said closed-loop element is a fit and comfort band constructed and sized to fit resiliently around said head.

8. The invention as claimed in claim 7, in which said fit and comfort band is thin, so as to fit between said padding or lining and said head.

9. The invention as claimed in claim 6, in which said connector means are a plurality of circumferentially-spaced flexible strips extended between said closed-loop element and said pad.

10. The invention as claimed in claim 9, in which said pad is a soft foam element connected to said strips.

11. The invention as claimed in claim 6, in which said protective athletic helmet is a baseball helmet having a solid synthetic resin shell, and having foam synthetic resin as said padding or lining.

12. A combination protective helmet and comfort element for an athlete, said combination comprising:

(a) a protective athletic helmet having a synthetic resin shell,
said shell having padding or lining interiorly thereof, (b) a closed-loop element adapted to circle the head of an athlete at the forehead and back of the head,
said closed-loop element being a fit and comfort band that is thin so as to fit between said head and said padding or lining,
said closed-loop element being sufficiently wide to occupy much space between said head and said padding or lining, and (c) means to support said band,
said means being adapted to rest on top of said head,
characterized in that said helmet and said band and said support means are present at the same time on said head, and
further characterized in that said helmet and said band are not connected to each other, and further characterized in that said helmet and said support means are not connected to each other.

13. The invention as claimed in claim 12, in which a crown pad is mounted above said fit and comfort band and connected thereto, said crown pad nesting between the crown of said head and the inner-center part of the top of said helmet, neither said fit and comfort band nor said crown pad nor the connection between said crown pad and fit and comfort band being connected to said helmet.

14. The invention as claimed in claim 12, in which said fit and comfort band has parallel outer and inner cloth layers, and thin padding between said layers.

15. The invention as claimed in claim 14, in which said outer layer is cotton broadcloth, said inner layer is cotton knit fabric, and said padding is fiberfill.

16. The invention as claimed in claim 15, in which said fiberfill is about ⅛ inch thick.

17. The invention as claimed in claim 12, in which inflation means are provided to partially inflate said band after the same is mounted on such head interiorly of the helmet.

18. A method of improving the fit and comfort of a protective helmet on the head of a person, which comprises:

(a) providing a fit and comfort band constructed and sized to fit resiliently around the head of a person with sufficient tightness to be a close fit on such head, but without sufficient tightness to create discomfort;

(b) mounting said band around such head, so that said band extends across the forehead, and across the back of such head at the upper end of the neck,
said mounting step being performed without any helmet being present at such head, (c) providing a protective helmet for such head,
said helmet having interior padding or lining that at the interior thereof is sized to fit such head but with sufficient clearance that said band will fit between such head and said padding or lining when said band is mounted around such head, (d) mounting said helmet on such head in such manner that said padding or lining fits around said band adjacent thereto,
said mounting of said helmet being effected as a separate step subsequently to said step of mounting said band, and (e) partially inflating said fit and comfort band after the same is mounted on such head and after said helmet is mounted over said band.

* * * * *